United States Patent [19]

Persch

[11] Patent Number: 4,638,917

[45] Date of Patent: Jan. 27, 1987

[54] TAMPER PROOF CLOSURE

[75] Inventor: Alois Persch, Zell, Fed. Rep. of Germany

[73] Assignee: Zeller Plastik Koehn, Graebner & Co., Zell, Fed. Rep. of Germany

[21] Appl. No.: 808,265

[22] Filed: Dec. 12, 1985

[51] Int. Cl.[4] ..... B65D 41/34

[52] U.S. Cl. ..... 215/252

[58] Field of Search ..... 215/252

[56] References Cited

U.S. PATENT DOCUMENTS

| | | | |
|---|---|---|---|
| 4,530,436 | 7/1985 | Wiedmer | 215/252 X |
| 4,534,479 | 8/1985 | Conti | 215/252 |
| 4,541,536 | 9/1985 | Davis et al. | 215/252 |

FOREIGN PATENT DOCUMENTS

| | | | |
|---|---|---|---|
| 1536459 | 7/1968 | France | 215/252 |

*Primary Examiner*—Donald F. Norton

*Attorney, Agent, or Firm*—Wells & Wells

[57] ABSTRACT

The invention concerns a tamper proof closure for a threaded mouth. The closure comprises a plastic cap provided by means of tear-off elements with a ring. If when the mouth is sealed the ring is still on the cap, then it displays the fact it was not opened yet. The ring is secured against a screwing-off motion by lock elements at the mouth. The ring is provided with at least one aperture entered by a catch on the cap. When the cap is rotated off, the catch destroys the ring. This can be facilitated by providing predetermined rupture sites in the shape of narrow connection strips between certain ring parts.

6 Claims, 6 Drawing Figures

FIG. 1
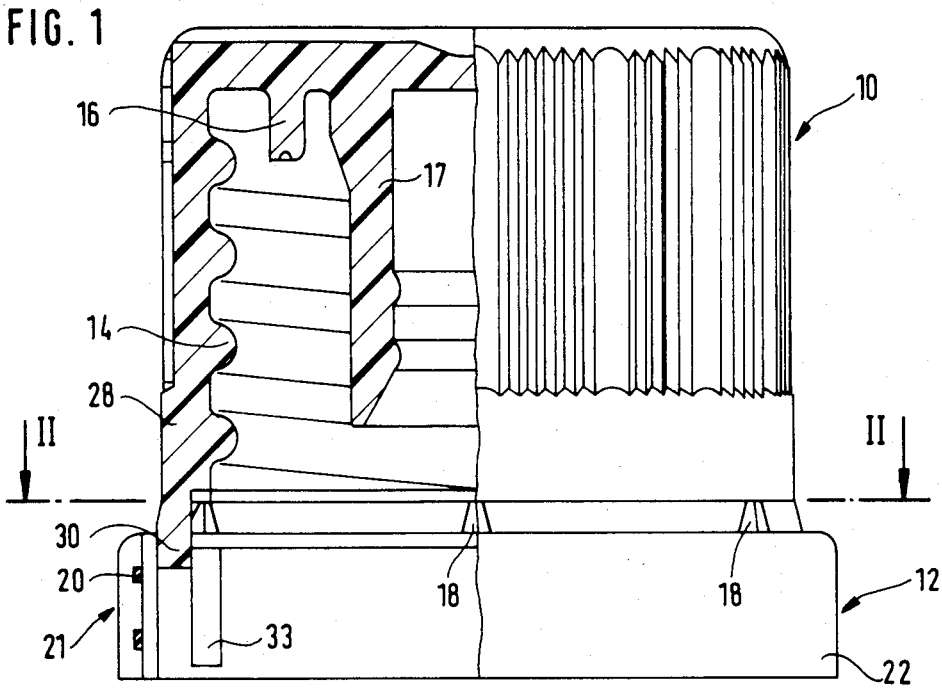
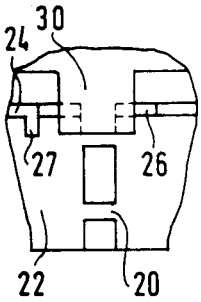
FIG. 6
FIG. 2
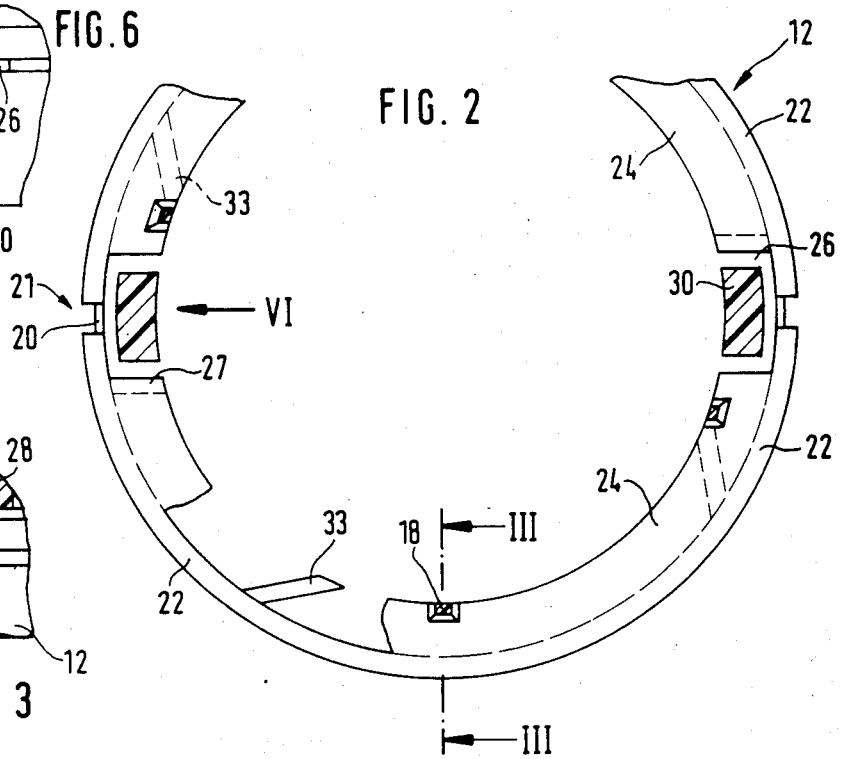
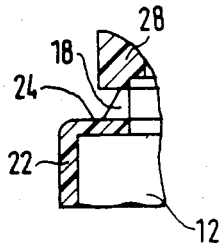
FIG. 3

FIG. 4
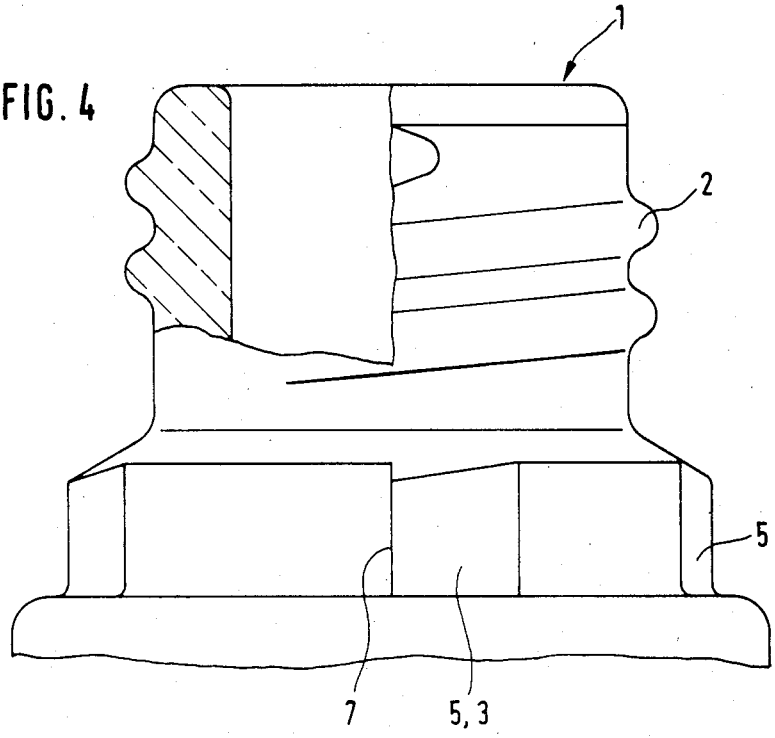
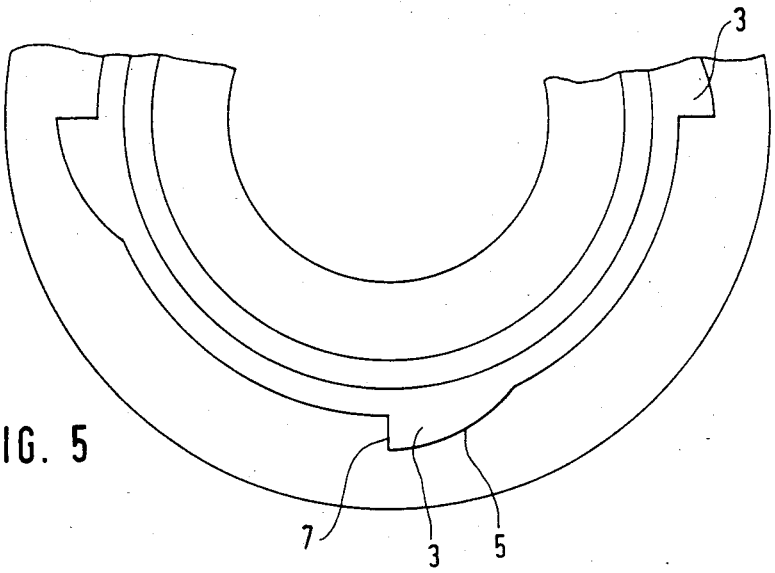
FIG. 5

TAMPER PROOF CLOSURE

BACKGROUND OF THE INVENTION

The invention concerns a tamper proof closure for a treaded container.

In a known tamper proof closure of this kind which is manufactured by the applicant, a screw cap together with the ring hanging from it can be screwed onto the bottle mount, with elastic lock elements at the ring snapping over corresponding lock elements at the bottle mount. When seen in the direction of screwing onto the bottle, the elastic elements of the ring point obliquely to the rear and act as pawls permitting the cap to be screwed on, but seize behind the lock elements of the mouth when there is a motion of screwing off, whereby they prevent reverse rotation of the ring. When the cap is further rotated in the reverse direction, the tear-off elements are then torn off the cap.

This design suffers from the drawback that the ring remains on the mouth. It does not adequately display in the closed state that the cap already was screwed off once. Furthermore there is danger that when the container is being emptied, the ring will drop off and for instance fall into poured-out contents.

SUMMARY OF THE INVENTION

The object of the present invention is to improve a tamper proof closure of the stated kind to the extent that when the cap is opened for the first time, the ring shall be decomposed into individual parts. On the other hand, the ring must cohere so strongly that it shall not be damaged during the screw-on motion.

This object is achieved by a tamper proof closure for a threaded container mouth having a ring attached to the cap by tear-off elements. Lock elements are provided on the mouth and ring to provide locking action when the cap is screwed on. Patches on the cap are accepted into apertures in the ring.

The cap catch which herein enters an aperture of the ring can be made so sturdy that it shall destroy the ring, it being assumed that the ring is made of a material allowing tearing or breaking.

Because the ring is destroyed, it drops off the mouth at the first opening motion which is thereby displayed; the ring cannot drop into the material being poured out.

FURTHER DESIGNS OF THE INVENTION

The ring may be provided with predetermined rupture sites to facilitate its destruction. This is important if the ring and the entire cap consist of an elastic plastic, which is advantageous with respect to the sealing elements and the elastic lock elements.

According to another embodiment, the predetermined rupture sites are appropriately arranged next to the apertures for the catches. The circumferential tractions exerted by the catches therefore are directly applied to the predetermined rupture sites.

According to still another embodiment, the apertures may enclose with play the catches and this feature is especially important in the circumferential direction. As a result, the catches will not transfer forces to the ring during the screwing-shut motion, that is, they will reliably be prevented from destroying it. When the cap is being screwed off, first the lock elements become operative and prevent the ring from being rotated off. Then the tear-off elements between the ring and the cap are torn apart. Thereupon the catches can freely move within their apertures, and after they have exhausted their play, they can circumferentially transmit forces to parts of the ring and tear this ring at the predetermined rupture sites.

In yet another embodiment, the catch is shaped in a manner allowing simple injection-molding manufacture of the cap.

BRIEF DESCRIPTION OF THE DRAWINGS

An illustrative embodiment with further features of the invention is described below in relation to the drawings.

FIG. 1 shows a screw-on cap with ring of the invention, in axial section on the left and in sideview on the right, FIG. 2 is a cross-section through the plane II—II of FIG. 1 and shows the ring, the tear-off elements, the lock elements and the catches, FIG. 3 is a section of the ring and the lowermost part of the cap, in a radial plane III—III of FIG. 2, FIG. 4 is a sideview of the bottle mouth, except for the upper left which is shown in axial section, FIG. 5 is part of a topview of the bottle mouth of FIG. 4, and FIG. 6 is a partial view in the direction of the arrow VI of FIG. 2.

DESCRIPTION OF THE PREFERRED EMBODIMENTS

FIGS. 4 and 5 show a mouth of a glass bottle. The mouth 1 has a thread 2 for a closure cap. Below the thread, the mouth is provided at a widening with four lock elements 3 in the shape of cams each with an outwardly convex ramp 5 rising clockwise and with a lock surface 7 extending in the radial plane.

FIGS. 1 and 2 show the associated screw cap 10 (hereafter termed merely "cap") which is provided with a ring 12 to protect against tampering. The ring and the cap may be injection molded polyethylene or polypropylene. The cap has an inside thread 14, a sealing ring 16 and a centering stub 17. The cap is joined by four tear-off elements 18 to the ring 12. The tear-off elements assume the approximate shape of frustra of pyramids of which the bases merge into the ring and the upper ends of which merge into the cap.

The ring consists of two segments (approximately halves) which are connected left and right only by two thin strips 20. Thereby are formed the predetermined rupture sites 21 between the two ring segments. Each of the ring segments has a jacket 22 and at the top an inside flange 24. The inside flange of each annular segment is shorter circumferentially than the jacket, in such a manner that an aperture 26 is created left and right in FIG. 2 which is located on the impact side between two ring segments and which is closed to the predetermined rupture site 21. Each inside flange 24 is provided at one of its ends with a downwardly projecting rib 27.

The cap jacket 28 is provided at each of opposite locations with a catch 30 in the shape of an extension in the axial direction which enters one of the apertures 26 of the ring with play in the circumferential direction with respect to the inside flanges 24 and furthermore radially with respect to the ring jackets 22. The function of the catch is to destroy the ring when the cap is screwed off.

Four lock elements 33 pointing obliquely inward are present on the jacket 22 of the ring. They subtend an angle approximately 45° with a radial plane. They cooperate with the lock elements 3 of the mouth. The entire cap inclusive the ring and the lock elements is made of an elastic plastic.

OPERATION

When the mouth is being screwed shut, the ring lock elements 33 at last arrive in the region of the mouth lock elements 3. They carry out a ratcheting motion, that is, they move outward on the ramp surfaces 5 and after having crossed each lock element snap in again. The connection strips 20 are thick and/or wide enough so that the ring withstands these stresses during the screw-on motion.

When screwing off, the cap initially can be rotated back until the lock elements by their free ends butt into the lock surfaces 7. This prevents further ring rotation. If the cap is rotated further, the tear-off elements 18 will tear apart. During the further rotation of the cap, the cap catches 30 move in the ring apertures 26 in the circumferential direction and then come into contact with the ribs 27 of the inside flanges 24 while the ring remains motionless. Upon further rotation with the required applied force, the connection strips 20 are torn apart at the two mutually opposite predetermined rupture sites 21. As a result the ring is divided into two halves which fall down.

VARIATIONS

The ring may be divided by predetermined rupture sites into more than two segments., whereby the number of catches 30 would be determined correspondingly. The predetermined rupture sites may be of another design than as shown. Illustratively a weakening in the ring jacket 22 suffices. Or more than two connecting strips, or only one, may be provided for each predetermined rupture site. The mouth should have at least two lock elements 3. The ring should have at least two, but also may have more than four lock elements 33.

I claim:

1. A tamper proof closure for a threaded container mouth having first lock elements thereon, said closure comprising:

(a) a plastic screw cap for sealing said mouth;

(b) a jacket divided into segments defining a ring around said cap for enclosing said mouth in a closed state;

(c) tear-off elements connecting said jacket and cap;

(d) connection strips located between said segments defining predetermined rupture sites;

(e) each of said segments provided with an approximately radially extending inside flange, said flange circumferentially shorter than said jacket, said flanges defining apertures between them;

(f) at least one catch on said cap adapted to enter said apertures; and (g) second lock elements provided inside said ring and cooperating with said first lock elements which facilitate relative rotation of said ring with respect to said mouth during a screwing shut motion but lock when screwing off.

2. The tamper proof closure of claim 1, wherein said connection strips have a smaller cross-section than said jacket.

3. The tamper proof closure of claim 2, wherein said predetermined rupture sites are positioned next to said apertures.

4. The tamper proof closure of claim 3, wherein said catch is an axially parallel extension of said cap.

5. The tamper proof closure of claim 4, having two segments.

6. The tamper proof closure of claim 5, having two catches.

* * * * *